US006544631B1

(12) United States Patent
Tanaka et al.

(10) Patent No.: US 6,544,631 B1
(45) Date of Patent: Apr. 8, 2003

(54) FIXING AGENT FOR DYE AND INK-JET RECORDING MEDIUM

(75) Inventors: Kanako Tanaka, Sakaide (JP); Akira Okada, Sakaide (JP)

(73) Assignee: Kyowa Chemical Industry Co., Ltd., Kagawa (JP)

( * ) Notice: Subject to any disclaimer, the term of this patent is extended or adjusted under 35 U.S.C. 154(b) by 75 days.

(21) Appl. No.: 09/889,202

(22) PCT Filed: Nov. 6, 2000

(86) PCT No.: PCT/JP00/07782

§ 371 (c)(1),
(2), (4) Date: Jul. 13, 2001

(87) PCT Pub. No.: WO01/36210

PCT Pub. Date: May 25, 2001

(30) Foreign Application Priority Data

Nov. 16, 1999 (JP) ..... 11-326001
Apr. 24, 2000 (JP) ..... 2000-122005

(51) Int. Cl.[7] ..... B41M 5/00

(52) U.S. Cl. ..... 428/195; 8/625; 8/632; 423/327.1; 423/332

(58) Field of Search ..... 8/625, 632; 423/327.1, 423/332; 428/195

(56) References Cited

U.S. PATENT DOCUMENTS 5,560,996 A * 10/1996 Ito et al. ..... 428/500
6,132,879 A 10/2000 Tamura et al.

FOREIGN PATENT DOCUMENTS

| | | |
|---|---|---|
| EP | 0633143 | 7/1994 |
| JP | 61-135785 | 12/1984 |
| JP | 11-078209 | 9/1997 |
| JP | 11-227318 | 2/1998 |
| JP | 2000-211917 | 1/1999 |

* cited by examiner

*Primary Examiner*—Bruce H. Hess
(74) *Attorney, Agent, or Firm*—Sherman & Shalloway

(57) ABSTRACT

A dye fixing agent for water-color ink to be contained in the water-color ink accepting layer of an ink jet recording medium having a water-color ink accepting layer formed on a substrate, which is a hydrotalcite compound containing a silicic acid anion and a sulfuric acid ion, or a silicic acid anion as an anion(s) and metal lithium. An ink jet recording medium comprising the dye fixing agent for water-color ink on a substrate.

The dye fixing agent for water-color ink provided by the present invention is excellent in the fixability of water-color ink and the ink jet recording medium provided by the present invention is excellent in the resolution, water resistance and light resistance of an image recorded on the medium.

6 Claims, No Drawings

FIXING AGENT FOR DYE AND INK-JET RECORDING MEDIUM

DETAIL DESCRIPTION OF THE INVENTION

1. Field of the Invention

The present invention relates to a water-soluble dye fixing agent which can be used in an ink jet recording medium to form a recorded image using water-color ink containing a water-soluble dye and to an ink jet recording medium comprising the same. Particularly, it relates to a dye fixing agent for ink jet recording media which is excellent in the fixability of water-color ink and the resolution, water resistance and light resistance of an image recorded on an medium and to an ink jet recording medium comprising the same.

2. Description of the Prior Art

Along with progress made in personal computers and digital cameras, displayed images have been recorded on printing paper like silver salt-based photographs. An image forming system called "ink jet recording system" is known as a system for recording such displayed images. Since this ink jet recording system has various features such as little noise, high-speed recording, easy for multi-color recording, wide adaptability of a recorded pattern and the elimination of need for development and fixing, it is used in many fields.

The principle of the ink jet recording system is that an ink solution is ejected from a nozzle by a drive source such as electric field, heat or pressure and transferred to the accepting layer of printing paper. The ink solution comprises a dye, water, polyhydric alcohol and the like and a water-soluble substantive dye or acidic dye is mainly used as the dye.

The printing paper is constructed by forming a dye accepting layer on a substrate and coated paper, glossy paper, glossy film, OHP film or the like is used as the substrate according to various needs. The accepting layer comprises a water-soluble polymer having excellent affinity for a dye, organic or inorganic filler and other auxiliary substances whose blending ratio is suitably adjusted to control the permeability of the dye and to suppress a blurred image.

Images obtained by this ink jet recording system now have high definition and as high quality as that of a silver-base photograph at a visible range thanks to recent marked progress made in the quality of the images and the improvement of dot density and the glossiness of the accepting layer.

JP-A 61-135785 (the term "JP-A" as used herein means an "unexamined published Japanese patent application") (JP-B 4-15747) (the term "JP-B" as used herein means an "examined Japanese patent publication") proposes that the light resistance of a substrate is improved by using synthetic silica and a hydrotalcite consisting of only a carbonic acid ion as a divalent anion in a dye accepting layer.

PROBLEMS TO BE SOLVED BY THE INVENTION

The substantive dye or acidic dye contained in the ink solution used in the ink jet system is retained in the accepting layer by interaction such as van der Waals binding force and hydrogen bond with the constituent components of the accepting layer after it has been transferred to the accepting layer as shown by the dyeing theory of dyes. Therefore, when an image formed on the accepting layer is contacted to a solvent or resin having high affinity for the dye or when heat energy large enough to cancel the interaction is supplied, the elution or transfer of the dye is induced, thereby causing such inconvenience as a blurred image. That is, the dye transferred to the accepting layer does not show completely stable fixability like a silver salt-based photograph. The same is said of stationery using a substantive dye or acidic dye and general image forming materials used for printing and the like.

Means for Solving the Problems

To cope with this, the inventors of the present invention have conducted studies to develop a fixing agent capable of stably fixing a dye in the water-color ink accepting layer of an ink jet recording medium having a water-color ink accepting layer formed on a substrate. That is, the inventors have conducted studies to develop a fixing agent which prevents the elution or transfer of a dye even when it is contacted to a solvent or resin having high affinity for the dye or when heat is supplied to the dye after the dye is transferred to the accepting layer and fixed.

The inventors have paid attention to a hydrotalcite compound as a fixing agent, synthesized various hydrotalcite compounds and investigated the dye fixing stabilities of the compounds.

As a result, they have found that the type of a metal and the type of an anion(s) forming a hydrotalcite compound are closely related to dye fixing stability and that a hydrotalcite compound containing metal lithium and having both a silicic acid anion and a sulfuric acid ion, or a silicic acid anion as an anion(s) has extremely stable dye fixability. It has also been found that when this hydrotalcite compound is used as a fixing agent, a high-definition image recording medium can be obtained. It has further been discovered that the hydrotalcite compound containing a silicic acid anion and a sulfuric acid ion, or a silicic acid anion as an anion(s) in a predetermined amount and having specific pore characteristics has more stable fixability.

According to the present invention, there is provided a dye fixing agent for water-color ink to be contained in the water-color ink accepting layer of an ink jet recording medium having a water-color ink accepting layer formed on a substrate, which is a hydrotalcite compound represented by the following formula (I):

$$LiAl_2(OH)_6(A_1^{n-})_c(A_2^{m-})_d \cdot zH_2O \quad (I)$$

wherein $A_1^{n-}$ is a silicic acid anion having a valence of n and a sulfuric acid ion ($SO_4^{2-}$), or a silicic acid anion having a valence of n, with the proviso that the silicic acid anion having a valence of n is an anion selected from the group consisting of $SiO_3^{2-}$, $HSiO_3^-$, $Si_2O_5^{2-}$ and $HSi_2O_5^-$, $A_2^{m-}$ is an anion selected from the group consisting of $CO_3^{2-}$, $NO_3^-$, $Cl^-$ and $OH^-$, z satisfies $0<z<4$, and c and d satisfy $0.5<nc+md<1.1$.

According to the present invention, there is further provided an ink jet recording medium which comprises a hydrotalcite compound containing the above specific anion(s) as a dye fixing agent.

The dye fixing agent for water-color ink and the ink jet recording medium comprising the same of the present invention will be described in detail hereinbelow.

The hydrotalcite compound used as the dye fixing agent for water-color ink of the present invention is characterized in that it contains metal lithium and a silicic acid anion and a sulfuric acid ion, or a silicic acid anion as an anion(s) forming the compound. More specifically, the hydrotalcite compound is more advantageously a hydrotalcite compound which contains a silicic acid anion and a sulfuric acid ion, or a silicic acid anion in an amount of 10 to 98 mol %, preferably 20 to 98 mol % based on the total of all the anions.

The silicic acid anion is $SiO_3^{2-}$, $HSiO_3^{31}$ , $Si_2O_5^{2-}$ or $HSi_2O_5^-$ and the sulfuric acid ion is $SO_4^{2-}$.

When the hydrotalcite compound used in the present invention contains a silicic acid anion and a sulfuric acid ion as anions, it contains the silicic acid anion in an amount of 5 to 100 mol %, preferably 10 to 100 mol %, particularly preferably 20 to 100 mol % based on the total of the silicic acid anion and the sulfuric acid ion.

It is advantageous that the hydrotalcite compound used in the present invention should have an average particle diameter measured by a laser diffraction scattering method of 0.1 to 10 $\mu$m, preferably 0.5 to 10 $\mu$m.

The hydrotalcite compound used in the present invention is represented by the following formula (I):

$$LiAl_2(OH)_6(A_1^{n-})_c(A_2^{m-})_d.zH_2O \quad (I)$$

wherein $A_1^{n-}$ is a silicic acid anion having a valence of n and a sulfuric acid ion ($SO_4^{2-}$), or a silicic acid anion having a valence of n, with the proviso that the silicic acid anion having a valence of n is an anion selected from the group consisting of $SiO_3^{2-}$, $HSiO_3^-$, $Si_2O_5^{2-}$ and $HSi_2O_5^-$, $A_2^{m-}$ is an anion selected from the group consisting of $CO_3^{2-}$, $NO_3^-$, $Cl^-$ and $OH^-$, z satisfies $0<z<4$, and c and d satisfy $0.5<nc+md<1.1$.

As described above, the hydrotalcite compound used in the present invention is characterized in that it contains metal lithium as a constituent metal and a specific anion(s) in a predetermined amount based on the total of all the anions.

In the above formula (I), the constituent metals are lithium (Li) and aluminum (Al) and the atomic ratio $Li/Al_2$ of the constituent metals is 1. However, when a hydrotalcite compound represented by the above formula (I) is synthesized and analyzed, the content of metal lithium as one of the constituent metals may not become a value which ensures that the atomic ratio $Li/Al_2$ is exactly 1 according to synthesis conditions, and the content of Li slightly changes. Even when the atomic ratio $Li/Al_2$ slightly changes, the hydrotalcite compound of the present invention is included in the scope of the present invention if it has the characteristic properties of its anion(s) and retains dye fixability. For example, it is included in the scope of the hydrotalcite compound of the above formula (I) if the content of metal lithium satisfies $0.8<Li/Al_2<1.1$, preferably $0.85<Li/Al_2<1.05$.

In the above formula (I), all the anions are represented by $(A_1^{n-}+A_2^{m-})$ and the hydrotalcite compound of the above formula (I) in which the proportion $(A_1^{n-}/(A_1^{n-}+A_2^{m-}))$ of the silicic acid anion and the sulfuric acid ion, or the silicic acid anion, represented by $A_1^{n-}$ to the total of all the anions is 10 to 98 mol %, preferably 20 to 98 mol % is used. Since it is difficult to obtain a hydrotalcite compound of the above formula ( I) in which all the anions are $A_1^{n-}$, the upper limit of the proportion of $A_1^{n-}$ to the total of all the anions is 98 mol %. When the proportion of $A_1^{n-}$ is smaller than 10 mol %, a fixing agent having low dye fixing stability is obtained disadvantageously.

The hydrotalcite compound of the above formula (I) which contains a silicic acid anion and a sulfuric acid ion, or a silicic acid anion as a dye absorbent in the present invention makes it possible to hold dye molecules between layers, thereby stabilizing the dye molecules, and to obtain an image having excellent ink absorptivity, resolution, water resistance and light resistance.

In the ink jet recording medium of the present invention, coating solution constituting substances other than the dye fixing agent for water-color ink will be described hereinbelow. To form a dye accepting layer on the substrate, a coating solution containing the dye fixing agent of the present invention is used. The coating solution comprises a polymer adhesive, additives and a solvent which are known per seas the main ingredients, in addition to the dye fixing agent. It may further contain an inorganic or organic pigment as required. The ink jet recording medium of the present invention may consist of a single layer or multiple layers and the substrate of the ink jet recording medium may be subjected to a corona treatment or anchor coat treatment to improve adhesion. The accepting layer may be a single layer or multi-layer as required.

An inorganic or organic pigment may be used as an auxiliary in the accepting layer as required. Examples of the pigment include inorganic pigments such as synthetic silica, colloidal silica, cationic colloidal silica, alumina sol, pseudo-boehmite gel, talc, kaolin, clay, baked clay, zinc oxide, zinc sulfide, zinc carbonate, tin oxide, aluminum oxide, aluminum hydroxide, aluminum silicate, calcium carbonate, calcium sulfate, calcium silicate, satin white, barium sulfate, titanium dioxide, magnesium silicate, magnesium carbonate, magnesium oxide, smectite, lithopone, mica, zeolite and diatomaceous earth; and organic pigments such as styrene-based plastic pigments, acrylic plastic pigments, microcapsuled plastic pigments, urea resin-based plastic pigments, melamine resin-based plastic pigments, benzoguamine-based plastic pigments and acrylic nitrile-based plastic pigments all of which are known per se in the field of general coated paper. A suitable pigment may be selected from these and used.

Examples of the polymer adhesive include (a) starches such as starch, oxidized starch, etherified starch and cationized starch; (b) cellulose derivatives such as methyl cellulose, carboxymethyl cellulose, hydroxyethyl cellulose, hydroxypropyl cellulose and hydroxypropylmethyl cellulose; (c) proteins such as gelatin, casein, soybean protein and synthetic protein; (d) natural and semi-synthetic adhesives such as agarose, guar gum, chitosan and soda alginate; (e) polyvinyl alcohol derivatives such as polyvinyl alcohol, cationic polyvinyl alcohol and silicon-containing polyvinyl alcohol; (f) synthetic, water-soluble and solvent-soluble adhesives such as polyethyleneimine-based resins, polyvinylpyrrolidone-based resins, poly(meth)acrylic acid and copolymers thereof, maleic anhydride-based resins, acrylamide-based resins, (meth)acrylate-based resins, polyamide-based resins, polyurethane-based resins, polyester-based resins, polyvinyl butyral-based resins, alkyd resins, epoxy-based resins, epichlorohydrin-based resins, urea resins and melamine resins; (g) conjugated diene-based latices such as styrene-butadiene copolymer and methyl methacrylate-butadiene copolymer, acrylic polymer latices such as acrylate and methacrylate polymers and copolymers, vinyl-based polymer latices such as ethylene-vinyl acetate copolymer, and modified polymer latices containing a functional group such as anionic group or/and cationic group thereof; and (h) conductive resins typified by polyvinylbenzyltrimethylammonium chloride, polydiallyldimethylammonium chloride, polymethacryloyloxyethyl-β-hydroxyethyldimethylammonium chloride and polydimethylaminoethyl methacrylate hydrochloric acid salts. These polymer adhesives known in this technical field are used alone or in combination.

Various additives may be added in limits that do not prevent fixability. The additives include conventionally known additives which are commonly used, such as a dispersant, anti-foaming agent, thickener, ultraviolet light absorber, fluorescent brightening agent, antioxidant, water resisting agent, surfactant, fluidity modifier, heat stabilizer, foam-inhibitor, foaming agent, tackifier, pH control agent, penetrant, wetting agent, heat gelling agent, lubricant, colorant, antiseptic, mildew-proofing agent, antistatic agent and crosslinking agent.

Preferred examples of the solvent of the coating solution include lower alcohols such as methyl alcohol, ethyl alcohol and propyl alcohol; glycols such as ethylene glycol, diethylene glycol, triethylene glycol and dioxane; lower alkyl esters such as methyl acetate and ethyl acetate; water-soluble organic solvents such as acetonitrile and dimethyl acetamide; and water. These solvents may be used alone or in admixture of two or more.

Woodfree paper, medium-grade woodfree paper, coated paper, art paper, cast coated paper, paper board, synthetic resin laminated paper, metal deposited paper, synthetic paper, white film or the like is used as the substrate of a recording medium which does not need to transmit light whereas glass or a film of polyethylene terephthalate, polyester, polystyrene, polyvinyl chloride, polymethyl methacrylate, polycarbonate, polyimide, cellulose triacetate, cellulose diacetate, polyethylene or polypropylene, such as an OHP sheet is used as the substrate of a light transmitting recording medium. The amount of the dye fixing agent is 10 to 90 wt %, preferably 15 to 90 wt % based on the total of solids (dye fixing agent, polymer adhesive, solid additives, pigment, etc.) constituting the accepting layer. When the amount of the dye fixing agent is too large, the accepting layer lacks flexibility and when the amount is too small, the accepting layer becomes inferior in dye fixability.

The method and means of forming a water-color ink accepting layer are not particularly limited and a suitable method may be employed according to the material of the substrate. The most common substrate coating method uses a bar coater, roll coater, air knife coater, blade coater, rod blade coater, brush coater, curtain coater, gravure coater, flexographic coater, cast coater, die coater, lip coater, size press or spray.

In addition to the above method in which a recording medium is obtained by forming a dye accepting layer on the substrate, there is another method in which a dye fixing agent is held on intertwined fibers and between them in the case of a recording medium comprising a dye accepting layer and a substrate both of which are integrated with each other, for example, pulp such as paper. An excellent recorded image forming material can be obtained by containing the dye fixing agent of the present invention in a substrate itself including a surface thereof.

A coating solution is prepared by using the above dye fixing agent, polymer adhesive, additives, pigment and solvent.

EXAMPLES

The following examples are given to further illustrate the present invention.

In reference examples, the measurement and evaluation of physical properties were carried out as follows.

(1) The BET specific surface area ($m^2/g$), total pore volume (ml/g) and average pore radius (nm) of a hydrotalcite compound (particles) were obtained from $N_2$ gas adsorption and desorption curves using the BELSORP 28SA gas adsorption apparatus of Nippon Bell Co., Ltd. after a measurement sample was maintained at 110° C. and $2.7\times10^{-}$ Pa or less for 3 hours as a pre-treatment. The total pore volume is the total volume of pores having a radius of 1 to 100 nm.

(2) The average particle diameter ($\mu$m) of a hydrotalcite compound (particles) was measured by the LA-910 laser diffraction/scattering system particle size distribution measuring instrument of HORIBA Co., Ltd.

(3) The unit layer interval (dÅ) of a hydrotalcite compound (particles) was measured by the RINT 2200V X-ray diffraction apparatus of Rigaku Co., Ltd.

Reference Example 1

10.24 g of lithium sulfate ($Li_2SO_4.H_2O$) as a guaranteed reagent and 0.16 liter of an aluminum sulfate aqueous solution having a concentration of 1.0 mol/l were dissolved in deionized water and the total amount was adjusted to 0.4 liter. This solution was placed in a 1-liter vessel and 0.32 liter of a 3 N sodium hydroxide aqueous solution was injected into the vessel at room temperature under stirring with a stirrer. After about 30 minutes of stirring, the resulting suspension was heated to carry out a reaction at 90° C. for 12 hours. After cooling [pH of the suspension was 11.39 (29.3° C.)], the suspension was filtered and washed. Thereafter, 1 liter of deionized water and the washed product were placed in a 2-liter vessel, fully dispersed and suspended by homomixer and heated at 90° C. A No. 3 water glass solution (0.08 mol of $SiO_2$) was added to carry out an ion exchange reaction at 90° C. for 1 hour. After cooling, the reaction product was filtered, washed, dried at 95° C. for 20 hours and ground (put through a 100-mesh sieve) to obtain a hydrotalcite compound represented by the following formula. The following formula is a composition formula derived from analytical results. The physical properties of this hydrotalcite compound are shown in Table 1 below.

$$Li_{0.94}Al_2(OH)_6(HSi_2O_5)_{0.26}(SO_4)_{0.27}(CO_3)_{0.03}.1.3H_2O$$

Reference Example 2

10.24 g of lithium sulfate ($Li_2SO_4.H_2O$ ) as a guaranteed reagent and 0.16 liter of an aluminum sulfate aqueous solution having a concentration of 1.0 mol/l were dissolved in deionized water and the total amount was adjusted to 0.4 liter. This solution was placed in a 1-liter vessel and 0.32 liter of a 3 N sodium hydroxide aqueous solution was injected into the vessel at room temperature under stirring with a stirrer. After about 30 minutes of stirring, the resulting suspension was heated to carry out a reaction at 90° C. for 12 hours. After cooling [pH of the suspension was 11.44 (29.5° C.)], the suspension was filtered and washed. Thereafter, 1 liter of deionized water and the washed product were placed in a 2-liter vessel, fully dispersed and suspended by a homomixer and heated at 90° C. A No. 3 water glass solution (0.16 mol of $SiO_2$) was added to carry out an ion exchange reaction at 90° C. for 1 hour. After cooling, the reaction product was filtered, washed, dried at 95° C. for 20 hours and ground (put through a 100-mesh sieve) to obtain a hydrotalcite compound represented by the following formula. The following formula is a composition formula derived from analytical results. The physical properties of this hydrotalcite compound are shown in Table 1 below.

$$Li_{0.92}Al_2(OH)_6(HSi_2O_5)_{0.51}(SO_4)_{0.15}(CO_3)_{0.03}.1.1H_2O$$

Reference Example 3

10.24 g of lithium sulfate ($Li_2SO_4.H_2O$) as a guaranteed reagent and 0.16 liter of an aluminum sulfate aqueous solution having a concentration of 1.0 mol/l were dissolved in deionized water and the total amount was adjusted to 0.4 liter. This solution was placed in a 1-liter vessel and 0.32 liter of a 3 N sodium hydroxide aqueous solution was injected into the vessel at room temperature under stirring with a stirrer. After about 30 minutes of stirring, the resulting suspension was heated to carry out a reaction at 90° C. for 12 hours. After cooling [pH of the suspension was 12.05 (26.3° C.)], the suspension was filtered and washed. Thereafter, 1 liter of deionized water and the washed product were placed in a 2-liter vessel, fully dispersed and suspended by a homomixer and heated at 90° C. A No. 3 water glass solution (0.26 mol of $SiO_2$) was added to carry out an ion exchange reaction at 90° C. for 1 hour. After cooling, the reaction product was filtered, washed, dried at 95° C. for 20 hours and ground (put through a 100-mesh sieve) to obtain a hydrotalcite compound represented by the following formula. The following formula is a composition formula derived from analytical results. The physical properties of this hydrotalcite compound are shown in Table 1 below.

$$Li_{0.94}Al_2(OH)_6(HSi_2O_5)_{0.61}(SO_4)_{0.17}(CO_3)_{0.02}.1.7H_2O$$

Reference Example 4

A hydrotalcite compound substantially containing $CO_3^{2-}$ as an interlayer anion (DHT4 of Kyowa Chemical Industry Co., Ltd.) is represented by the following chemical formula.

$$Mg_{4.28}Al_2(OH)_{12.56}(CO_3)_{0.99}(SO_4)_{0.009}.3.5H_2O$$

Reference Example 5

The physical properties of commercially available synthetic silica (trade name: Fine Seal of Tokuyama Corporation) are shown in Table 1 below.

Examples 1 to 3 and Comparative Examples 1 to 3

(Evaluation of Ink Jet Recording Medium)

Preparation of Ink Jet Recording Medium

The hydrotalcite compounds obtained in the above Reference Examples 1 to 4 and synthetic silica (Reference Example 5) were used to prepare ink jet recording media in accordance with the following method.

40 parts by weight of polyvinyl alcohol as a polymer adhesive, 5 parts by weight of polyethyleneimine which is a cationic resin as an additive and 0.02 part by weight of phosphoric acid as a neutralizer were added to and mixed with 100 parts by weight of the hydrotalcite compound or synthetic silica to obtain a coating solution having a solid content of 18 wt %. This coating solution was applied to paper by a No.20 bar coater and dried to obtain an ink jet recording medium.

Ink Jet Printing

Cyanogen (C), magenta (M), yellow (Y) and black (B) inks were printed on the obtained ink jet recording medium by an ink jet recording device (BJ F200 of Canon Inc.).

Evaluation of Printing Properties

The (1) ink absorptivity (color development properties), (2) resolution, (3) water resistance and (4) light resistance of each ink jet recording medium were evaluated as follows.

(1) Ink Absorptivity (Color Development Properties)

A full color image formed on a printing sheet was observed visually. The evaluation of ink absorptivity was carried out based on the following criteria. 5; The image has high density in all the colors and is clear. 4; The image has high density in all the colors. 3; The image has low density in some colors but has no practical problem. 2; The image has low density in some colors. 1; The image has low density in all the colors and is not clear.

(2) Resolution

All the dots were observed through an optical microscope (BHSM-313MU of Olympus Optical Co., Ltd.). The evaluation of resolution was carried out based on the following criteria. 5; All the dots are very sharp. 4; All the dots are sharp. 3; Some dots are not sharp but there is no practical problem. 2; Some dots keep their shape. 1; None of the dots keeps their shape.

(3) Water Resistance

The printed surface was immersed in water for 1 minute and the running of ink after drying was observed. The evaluation of water resistance was carried out based on the following criteria. 5; The dye of the printed portion does not run or blot on the paper at all. 4; The dye of the printed portion runs a little but rarely blots. 3; The dye of the printed portion runs a little and blots slightly but there is no practical problem. 2; The dye of the printed portion runs and blots and the printed characters are hardly identified. 1; The dye of the printed portion runs and blots considerably and the printed characters cannot be identified (4) Light Resistance Solid printing of cyanogen (C), magenta (M), yellow (Y) and black (B) inks was carried out and the printed inks were exposed to light until the class 5 blue scale was discolored to a standard level using a Sunshine weather meter (WEL-SUN-HC-B of Suga Shikenki Co., Ltd.) so as to measure and evaluate light resistance using a color difference colorimeter (ZE-2000 of Nippon Denshoku Kogyo Co., Ltd.). The evaluation was made based on a ΔE value.

⊙; $0 \leqq \Delta E \leqq 5$

○; $5 < \Delta E \leqq 10$

Δ; $10 < \Delta E \leqq 20$

×; $\Delta E > 20$

Evaluation Results of Printing Properties

The evaluation results are shown in Table 2 below. In Comparative Example 3, commercially available ink jet paper (Super Hi-grade KJ-1210 of Kokuyo Co., Ltd.) was used.

TABLE 1

| | average particle diameter (μm) | BET ($m^2/g$) | total pore volume (mL/g) | average pore radius (nm) | unit layer interval | bulk |
|---|---|---|---|---|---|---|
| R.Ex. 1 | 2.94 | 31.8 | 0.08 | 9.8 | 8.652 | 89/65 |
| R.Ex. 2 | 1.64 | 29.0 | 0.11 | 7.4 | 11.724 | 117/95 |
| R.Ex. 3 | 2.14 | 30.6 | 0.10 | 8.5 | 11.414 | 133/97 |
| R.Ex. 4 | 0.67 | 13.1 | 0.05 | 8.7 | 7.642 | 45/36 |
| R.Ex. 5 | 10.1 | 292 | 3.7 | 10 | — | 102/91 |

R.Ex.: Reference Example

TABLE 2

| | sample name | ink absorptivity | reso-lution | water resistance | light resistance Y | M | C | B |
|---|---|---|---|---|---|---|---|---|
| Ex. 1 | R.Ex. 1 | 5 | 4 | 5 | ○ | ○ | ⊙ | ⊙ |
| Ex. 2 | R.Ex. 2 | 4 | 5 | 5 | ○ | ○ | ⊙ | ○ |
| Ex. 3 | R.Ex. 3 | 4 | 5 | 4 | ○ | ○ | ○ | ○ |
| C.Ex. 1 | R.Ex. 4 | 2 | 2 | 3 | ○ | Δ | Δ | Δ |
| C.Ex. 2 | R.Ex. 5 | 3 | 2 | 2 | ○ | X | Δ | Δ |
| C.Ex. 3 | — | 5 | 4 | 5 | ○ | X | X | X |

Ex.: Example
C.Ex.: Comparative Example
R.Ex.: Reference Example

What is claimed is:

1. A dye fixing agent for water-color ink to be contained in the water-color ink accepting layer of an ink jet recording medium having a water-color ink accepting layer formed on a substrate, which is a hydrotalcite compound represented by the following formula (I):

$$LiAl_2(OH)_6(A_1^{n-})_c(A_2^{m-})_d.zH_2O \quad (I)$$

wherein $A_1^{n-}$ is a silicic acid anion having a valence of n and a sulfuric acid ion ($SO_4^{2-}$), or a silicic acid anion having a valence of n, with the proviso that the silicic acid anion having a valence of n is an anion selected from the group consisting of $SiO_3^{2-}$, $HSiO_3^-$, $Si_2O_5^{2-}$ and $HSi_2O_5^-$, $A_2^{m-}$ is an anion selected from the group consisting of $CO_3^{2-}$, $NO_3^-$, $Cl^-$ and $OH^-$, z satisfies $0<z<4$, and c and d satisfy $0.5<nc+md<1.1$.

2. The dye fixing agent for water-color ink according to claim 1, wherein the hydrotalcite compound contains a silicic acid anion and a sulfuric acid ion, or a silicic acid anion in an amount of 10 to 98 mol % based on the total of all the anions.

3. The dye fixing agent for water-color ink according to claim 1, wherein the hydrotalcite compound contains a silicic acid anion and a sulfuric acid ion, or a silicic acid anion in an amount of 20 to 98 mol % based on the total of all the anions.

4. The dye fixing agent for water-color ink according to claim 1, wherein the hydrotalcite compound contains a silicic acid anion and a sulfuric acid ion in an amount of 10 to 98 mol % based on the total of all the anions, and the proportion of the silicic acid ion to the total of the silicic acid anion and sulfuric acid ion is 5 to 100 mol %.

5. The dye fixing agent for water-color ink according to claim 1, wherein the hydrotalcite compound has an average particle diameter of 0.1 to 10 $\mu$m.

6. An ink jet recording medium having a water-color ink accepting layer which comprises the dye fixing agent of claim 1 and is formed on a substrate.

* * * * *